US006375604B1

(12) United States Patent
Verhines

(10) Patent No.: US 6,375,604 B1
(45) Date of Patent: Apr. 23, 2002

(54) METHOD OF FORMING A TABBED ASSEMBLY

(75) Inventor: Rick J. Verhines, Marina del Rey, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/335,154

(22) Filed: Jun. 16, 1999

Related U.S. Application Data

(62) Division of application No. 08/958,557, filed on Oct. 29, 1997.

(51) Int. Cl.[7] ..... B31B 1/88

(52) U.S. Cl. ..... 493/325; 493/375; 493/386; 493/409; 493/947; 493/961; 40/638; 40/641

(58) Field of Search ..... 493/320, 323, 493/325, 375, 386, 409, 947, 961; 40/638, 641

(56) References Cited

U.S. PATENT DOCUMENTS

| | | | |
|---|---|---|---|
| 561,888 | A | 6/1896 | Hon |
| 1,151,475 | A | 8/1915 | Kingsley et al. |
| 1,559,129 | A | 10/1925 | Pimm |
| 1,732,541 | A | 10/1929 | Sacerdote |
| 1,736,165 | A | 11/1929 | McMillan |
| 1,785,780 | A | 12/1930 | Maish |
| 2,300,623 | A | 11/1942 | Hornung |
| 3,054,202 | A | 9/1962 | Scholfield |
| 3,205,597 | A | 9/1965 | Stern |
| 3,245,162 | A | 4/1966 | McElroy |
| 3,371,850 | A | 3/1968 | Gorman |
| 3,808,718 | A | 5/1974 | Christiansen |
| 3,822,492 | A | 7/1974 | Crawley |

(List continued on next page.)

FOREIGN PATENT DOCUMENTS

| | | |
|---|---|---|
| WO | WO 97/32736 | 12/1997 |
| WO | WO 97/32737 | 12/1997 |

*Primary Examiner*—Rinaldi I. Rada
*Assistant Examiner*—Christopher Harmon
(74) *Attorney, Agent, or Firm*—Oppenheimer Wolff & Donnelly LLP

(57) ABSTRACT

Tab material which is wrapped tightly around an edge of a sheet is adhered flat to both faces of the sheet. The sheet is passed through a printer, and indicia is printed on both sides of a tab material fold line on at least a portion of the tab material on one of the faces. Then, the tab material portion is released from that face, folded onto itself on the fold line, and the end of that portion is re-adhered to that face but closer to the sheet edge. Thereby, the folded tab material portion extends out from the edge and has indicia printed on both sides thereof to define a tab. Pursuant to one embodiment, a series of these tab material portions line that face along the edge, separated from one another by die cut lines. The user can then select the portion to be released from the face, folded onto itself and its end attached to the face to define an outwardly extending tab at the desired place anywhere along the edge. Should the desired location of the tab change, the end of the tab defining portion can be detached, the portion unfolded and reattached flat against the face. Another portion at the desired new tab location along the edge can then be released, folded and its end attached to the face to define the new tab. Pursuant to another embodiment, a plurality of smaller end products are defined by microperforation lines on the sheet. Each product abuts an edge of the sheet and wrapped tab material is provided for each. Indicia is printed on each of the tab materials, the end products are separated from the rest of the sheet by pulling along the microperforation lines, and the tab material for each is released, folded and re-adhered. Thereby, a plurality of printed tabbed cards, such as flip-file cards, are formed.

46 Claims, 7 Drawing Sheets

OTHER PUBLICATIONS

| | | | | | |
|---|---|---|---|---|---|
| 3,854,229 | A | | 12/1974 | Morgan | |
| 3,924,744 | A | | 12/1975 | Heimann | |
| 4,184,699 | A | | 1/1980 | Lowe, Jr. | |
| 4,329,191 | A | | 5/1982 | Barber | |
| 4,560,600 | A | | 12/1985 | Yellin et al. | |
| 4,580,815 | A | * | 4/1986 | Barber | 283/81 |
| 4,637,149 | A | | 1/1987 | Rivkin | |
| 4,784,508 | A | | 11/1988 | Shannon | |
| 4,876,131 | A | | 10/1989 | Ashby et al. | |
| 4,962,603 | A | | 10/1990 | Kao et al. | |
| 4,972,615 | A | | 11/1990 | Grant | |
| 5,016,370 | A | | 5/1991 | Rhian et al. | |
| 5,135,261 | A | | 8/1992 | Cusack et al. | |
| 5,400,957 | A | | 3/1995 | Stude | |
| 5,401,058 | A | | 3/1995 | Holmberg | |
| 5,407,234 | A | | 4/1995 | Rettker et al. | |
| 5,451,440 | A | | 9/1995 | Tynan, Jr. | |
| 5,462,783 | A | | 10/1995 | Esselmann | |
| 5,468,085 | A | | 11/1995 | Kline | |
| 5,518,273 | A | * | 5/1996 | Olson | 283/36 |
| 5,524,998 | A | | 6/1996 | Schwartz | |
| 5,540,513 | A | | 7/1996 | Wyant | |
| 5,597,634 | A | | 1/1997 | Bloomer et al. | |
| 5,622,761 | A | | 4/1997 | Cole | |
| 5,656,347 | A | | 8/1997 | Tynan, Jr. | |
| 5,906,397 | A | * | 5/1999 | MacWilliams | 283/36 |
| 6,039,354 | A | * | 3/2000 | Mangler | 281/38 |

* cited by examiner

METHOD OF FORMING A TABBED ASSEMBLY

CROSS-REFERENCE TO RELATED APPLICATION

This is a divisional of copending application Ser. No. 08/958,557, filed Oct. 29, 1997.

BACKGROUND OF THE INVENTION

The present invention relates to tab sheet and flip-file card assemblies and methods for forming tabbed sheets, dividers or cards with the desired indicia printed on the tabs thereof.

A number of brands of software are available for causing laser, ink jet and other printers or copiers to print the desired indicia directly on tabs of dividers. However. the tabs of these dividers extend approximately one-half inch out from the divider sheet edge, which causes printer feeding problems. Where the body of the sheet has a width of 8-½ inches, the one-half inch wide tab makes the effective sheet width nine inches. Unfortunately, many standard printers or photocopiers can only accept rectangular sheets whose widths do not exceed 8-½ inches.

Also, when tabbed dividers are fed in the portrait direction of the divider sheet using multipurpose or cassette trays into ink jet, electrophotographic or laser printers, the dividers tend to skew as they enter the printer. This skewing occurs because the tabs, by sticking out from the edge of the body of the sheet, do not provide full continuous contact of each divider to the paper guide of the (multipurpose) printer tray. Additionally, since the paper guide is much shorter than the divider itself. the last few tab positions do not contact the paper guide; specifically, the fourth and fifth tabs of a five tab set and the fifth through eighth tabs of an eight tab set do not contact it. When these dividers are fed into the printer, the tabs can catch causing the dividers to not feed straight into the printer.

SUMMARY OF THE INVENTION

Directed to remedying the problems in the prior art, disclosed herein is an improved user-printable divider sheet or page with one or a series of reconfigurable tabs. Thin tab material is wrapped tightly around the edge of a divider sheet and adhered flat against both faces of the sheet. It thereby does not add significantly to the width or thickness dimensions of the sheet and obstruct feeding of the sheet into the printer.

The tab material is selected to accept and display clearly and cleanly indicia which is printed thereon by the printer, as desired by the user. After the indicia has been printed on the tab material on the first face and the sheet removed from the printer, the tab is formed. To form the tab, the tab material is released from the first face (but not the second face of the sheet). Then the released material is folded over onto itself and the distal end attached to the first face. Preferably the tab material is preformed with a fold line on the sheet first face side thereof and (the same) indicia is printed on both sides of the fold line. Then with the released tab material folded on the line to form the outwardly extending tab, the indicia is provided on both sides thereof, easily visible on both sides of the tabbed divider sheet The tab material can be provided the length (or a substantial portion thereof) of the sheet edge on the first and second faces thereof, and divided into segments on the first face along the edge. Indicia can be printed on each of the segments, and each can be selectively released, folded and attached to form separate printed tabs. The segment selected will be at the desired location of the tab along the edge. Should tab needs change, the tab can be disconnected and that segment reattached in the original tab material position on the first face. If desired, another segment can be released, folded and attached to form a tab at a different location on the sheet edge.

That is, according to a preferred embodiment tie entire, for example, an 8½×11 inch, sheet (or other printable media) which is passed through the printer or copier forms the end product, for example, a tabbed divider sheet. Pursuant to another embodiment, the sheet after the printing operation on its tabbed material(s) is divided into separate smaller end products. They can be separated along perforation, substantial cut or through-cut lines, or a combination thereof. These lines are preferably preformed; that is, the sheets are provided to the user with the separation lines preformed therein defining the outlines of the smaller end products. At least one of the edges of the products can be conveniently defined by one or more edges of the sheet, for example at the sheet corner.

Tab material units are attached, as described above, to each of the sheet portions of the sheet, in an unfolded condition and flat against one face of the sheet. When the sheet is subsequently passed through the printer or copier, the desired indicia is printed on each of the tab material units, preferably on both sides of the score lines thereof. The printer or copier can be programmed to print the same or preferably different indicia on each tab unit on the sheet.

After the sheet has passed through the printer or copier and the indicia printed on the tab material units, the sheet is separated into its smaller end product units. Each is separated by pulling or tearing along its separation lines. After separation (or less preferably before), the tab material unit is released from the first face of the sheet, folded on the score line and reattached as described previously. Thereby, a plurality of (smaller) products, each with its own outwardly-extending tab with indicia printed on both tab sides, can be formed from a single sheet. One preferred configuration of these products is a flip-file card or ROLODEX card with the two slots along a bottom edge for fitting onto the rings of a flip-file card holder. The tab material can be attached at different locations along the top edges of the cards, to stagger or offset them from those of adjacent cards, to provide for easier reading and card access.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
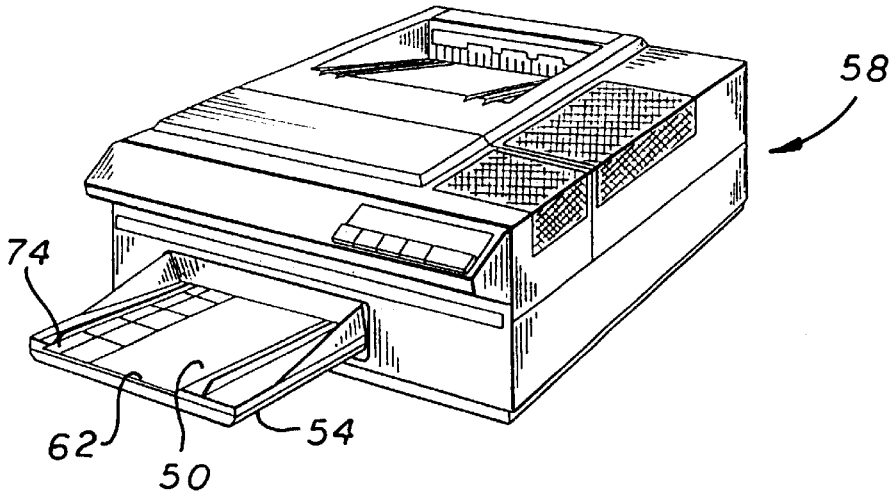
FIG. 1 is a perspective view of a tab sheet assembly of the present invention shown in a feed tray of a printer ready for a printing operation thereon.
Figure 3:
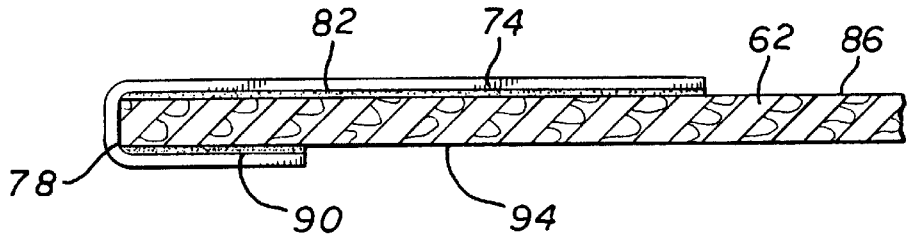
FIG. 3 is an enlarged cross-sectional view taken on line 3—3 of FIG. 2.

Referring to the drawings, a number of embodiments of the present invention are illustrated. One preferred embodiment is shown in FIG. 1 by tab sheet assembly 50 positioned in a feed tray 54 of a printer shown generally at 58. The printer 58 can be an ink jet, electrophotographic or laser printer. An example of a preferred printer 58 is the Laser Jet III printer available from Hewlett Packard.

Tab sheet assembly 50 includes a main body sheet 62. Sheet 62 preferably comprises paper, such as paperboard, cover stock, or Bristol paper available from manufacturers such as Champion or International paper. The paper is 0.004 to 0.011 inch thick, is an 8-½ by eleven (or thirteen or fourteen) inch rectangle (or is International A4 size) and has a weight of 100–230 grams per square meter. Holes 66 can be provided near the binding edge 70 for securing the sheet 62 in a ring binder (not shown) or the like. The binding edge 70 can be reinforced by lamination with a strip of high strength plastic film (not shown) such as polyethylene terephthalate adhesively attached therealong.

Figure 3A:
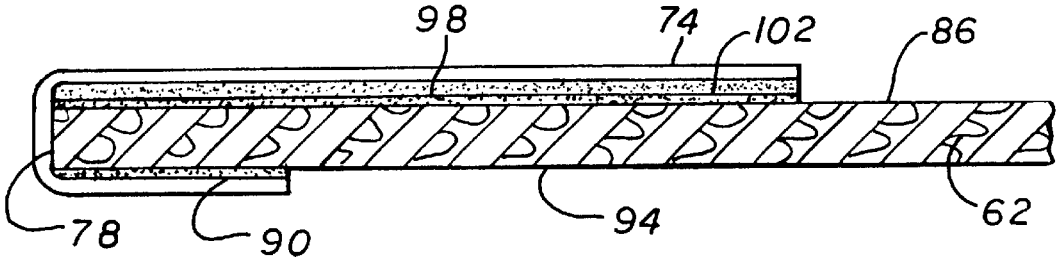
FIG. 3*a* is a view similar to FIG. 3 showing an alternative adhesive construction therefor.

A strip of flexible sheet material or tab material 74 is wrapped around the opposite edge 78 of the sheet 62. The material 74 is preferably based on an opaque plastic film, such as polyethylene terephthalate (e.g. Mylar™) having a thickness of 0.002–0.004 inch, which is coated with a composition such as those taught by Rettker et al., U.S. pat. No. 5,407,234, suitable for being printed thereon by common desktop printers, such as (ink jet or laser electrophotographic) printer 58. A repositionable or releasable adhesive 82, such as UR-1 adhesive available from Avery Dennison, releasably attaches the material 74 to the first or rear face 86 of the sheet 62. A permanent pressure sensitive adhesive 90, such as P-9 adhesive available from Avery Dennison, attaches the material 74 to the second or front face 94 of the sheet 62. In lieu of the repositionable adhesive 82, a permanent adhesive 98 such as the P-9 adhesive, applied to the flexible sheet material 74 with a coating 102 to facilitate release applied to the sheet 62 can be used, as shown in FIG. 3*a*. (While a "permanent" adhesive cannot be separated from the underlying paper sheet without tearing the fibers of the paper, a "releasable" adhesive can. A releasable adhesive also does not leave an adhesive residue.)

Figure 6A:
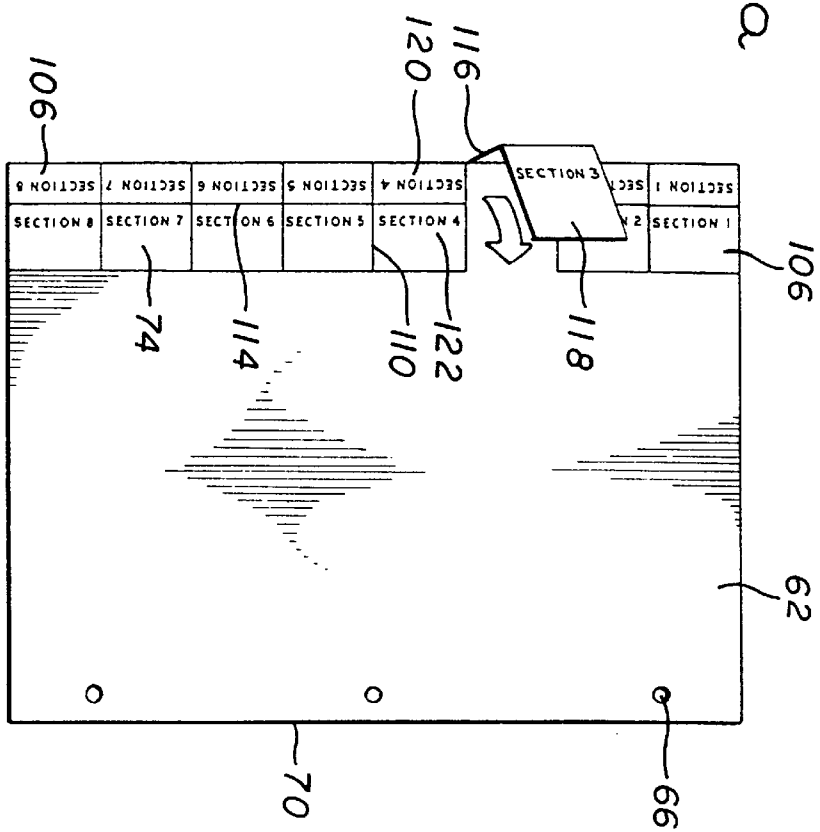
FIG. 6*a* is a view of the sheet of FIG. 4 showing a first step of a substitute tab forming procedure.

In other words, the flexible sheet material 74 wraps around the edge 78 of the divider sheet 62, extending onto the front face 94 of the sheet. The reinforcing material 74 is continuous along the front face 94. It is subdivided according to one preferred embodiment, however, along the back face 86 into segments 106 by die cuts 110 which extend through the film 74, but not into the sheet 62, as shown in FIG. 6*a*, for example. That is, these cuts 110 extend perpendicular to the edge 78 of the sheet 62 and across the full width of the material 74 and divide the material into segments 106. A score line 114, parallel to edge 78, divides the segments 106 into front and rear panels 116, 118 to facilitate subsequent folding in a later formation step.

Figure 5:
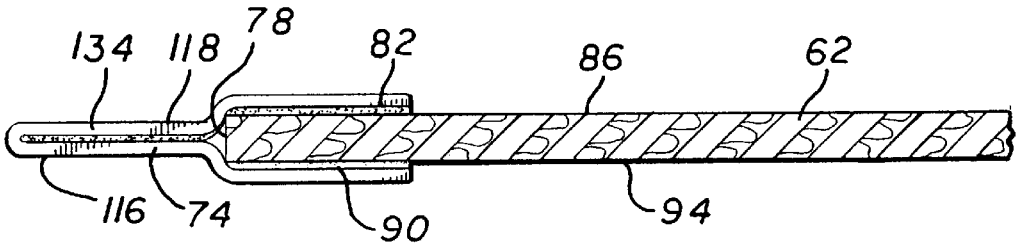
FIG. 5 is an enlarged cross-sectional view taken on line 5—5 of FIG. 4.
Figure 2:
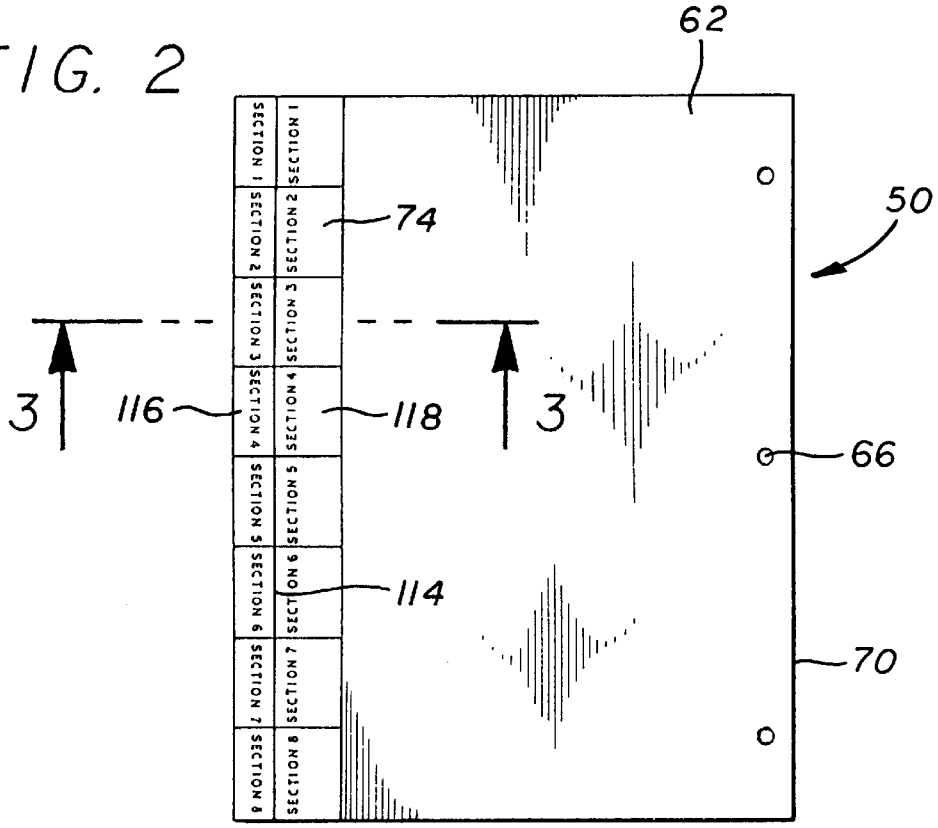
FIG. 2 is an enlarged rear plan view of the tab sheet assembly of FIG. 1 after the printing operation.

The consumer using commonly available software, such as Word available from Microsoft, causes the desktop printer 58 to print indicia 120, 122 on specific segments 106 of the material 74 on the back face 86 of the sheet 62. One, some or all of the segments 106 may be printed, as shown in FIG. 2. Following printing, the user releases the desired segment 106 by peeling it off from the sheet 62. He then rotates it towards the front face 94 and folds it on the score line 114. The end 130 of the segment 106 is reattached with the repositionable adhesive 82 to the back face 86 proximate to the edge 78, as shown in FIG. 5. A tab 134 extending out from the edge 78 of the sheet 62 is thereby formed with properly oriented indicia 120, 122 on the front and rear tab faces.

As shown in FIG. 5, the panels 116, 118 adhere to each other to form a double-thickness tab 134. The portions of the tab material 74 adhesively attached to the front and rear faces 94, 86 of the sheet 62 stabilize the tab 134 against pivotal motion.

Figure 4:
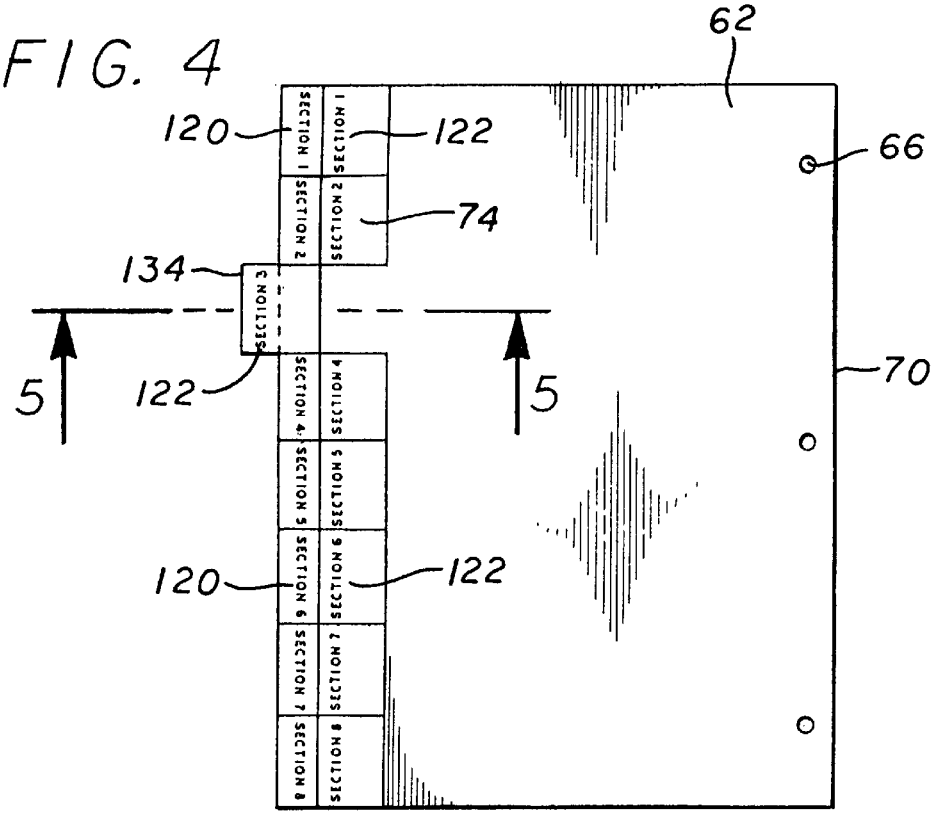
FIG. 4 is a view similar to FIG. 2 after a tab forming operation thereon.
Figure 7A:
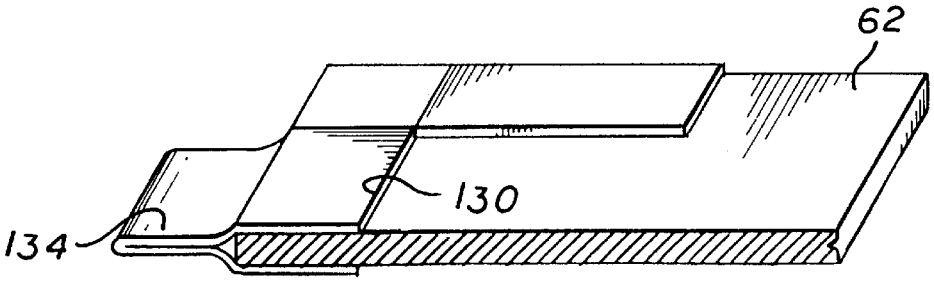
FIG. 7*a* is a perspective view of the tab of FIG. 6*b*.
Figure 7B:
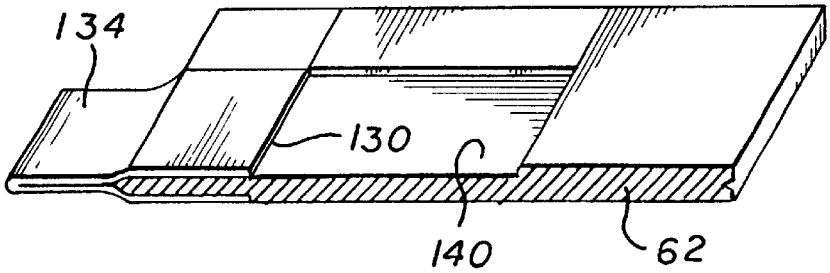
FIG. 7*b* is a perspective view similar to FIG. 7*a* of an indented alternative embodiment.

Although the reinforcing film or tab material 74 is normally much thinner than the base sheet 62, it may be desirable to indent the base sheet underneath the film, by approximately 0.002 inch. This is to compensate for the thicknesses of the film 74, to thereby achieve a more or less uniform thickness profile in the assembly 50 prior to printing to facilitate printability. The indenting can be made with the following process: prior to cutting the paper into sheets it is passed between a pair of rollers shaped so as to impress an indentation of the desired depth into the paper in a continuous fashion at the desired position relative to the edge of the page on one or both faces of the web. FIG. 7*a* is a perspective cross-sectional view through a tab such as shown by line 5—5 in FIG. 4. FIG. 7*b* is similar to FIG. 7*a* but shows an indented embodiment of the invention with the indented area shown by reference numeral 140.

Using the present assembly 150, indicia 120, 122 which later appear on both sides of the tab 134 advantageously can be printed in a single pass through the desktop printer 58. This is because both sets of indicia (that which will appear on the front and back of the tab 130) are printed on the same side or face of the assembly 50, as can be understood from FIG. 23, for example.

Unlike pre-cut divider tabs, all tab positions are alike prior to printing. This eliminates the need to possess and select any particular tab position.

Figure 6B:
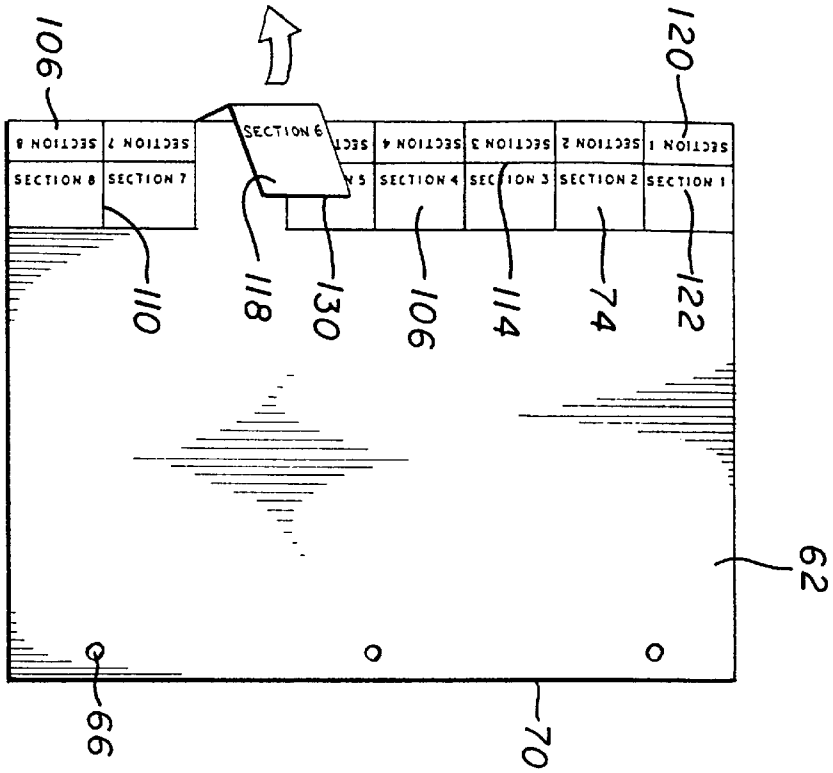
FIG. 6*b* is a view of the sheet of FIG. 6*a* showing a second step thereof.

The user can "reposition" the tab 134 by releasing the section from the adhesive, unfolding it and reattaching it flat against the body face 84 as shown in FIG. 6*a*, and unfolding and tab forming another section as shown in FIG. 6*b*. The same indicia can be printed by the printer 58 on all segments as shown, or different indicia can be printed on each, as shown in FIG. 2. That is, if needs change and the tab is needed in position #6 instead of #3, then tab #3 is deconstructed using the repositionable adhesive and tab #6 is formed, as can be understood by comparing FIGS. 6*a* and 6*b*. This is in lieu of printing up a new sheet with tab #6 printed. Color coding and other visual indexing cues, as known to those skilled in the art, can also be used to provide further user convenience.

Figure 8A:
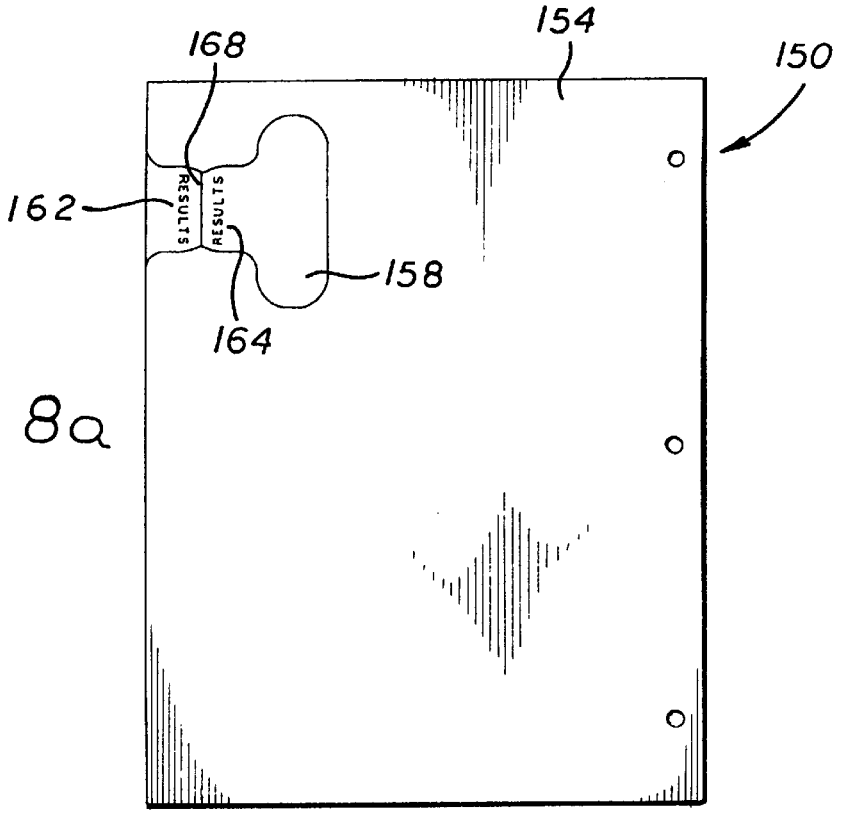
FIG. 8*a* is a rear plan view of an alternative sheet assembly of the present invention.
Figure 8B:
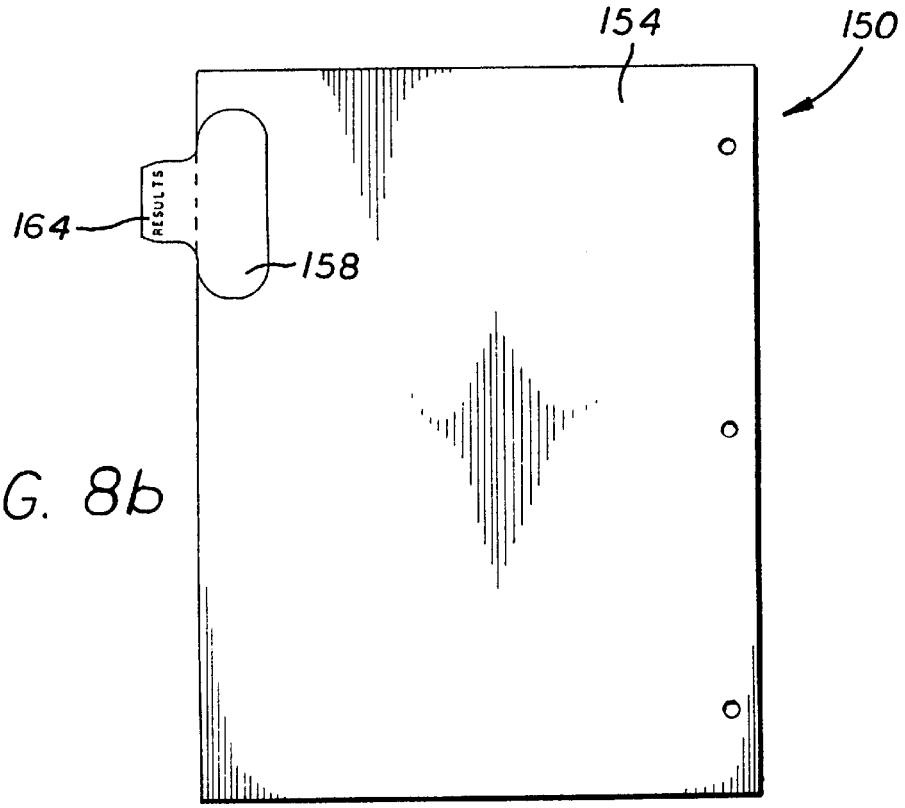
FIG. 8*b* is a view of the sheet assembly of FIG. 8*a* in a tab formed condition.

FIGS. 8*a* and 8*b* show an alternative assembly embodiment 150. Rather than a single blank strip of material 74 with a series of tab positions along the edge, assembly 150 is a more conventional position-specific design. A page or sheet 154 with a single "shoulder cut" tab construction 158 made using a similar printable reinforcing film releasably attached to the sheet and after a printing operation to print indicia 162, 164 on opposite sides of score line 168 thereon is shown in these figures. The tab is then released, folded and reattached as shown in FIG. 8*b* and similar to assembly 50.

Again, by releasing, rotating, folding and reattaching, a sturdy tab, attractively printed on both faces thereof can be created by the consumer using common personal computing and printing hardware and software. This locates the fold at the tab and provides for superior rigidity by anchoring the tab through the "feet" attached to both faces of the page.

The printed tabbed end products, such as a tabbed index sheet, include the entire sheet 62. However, another embodiment of this invention includes only a portion of the sheet as the end product. That is, and referring to FIGS. 9–12, after the sheet 200 has been passed through the printer or copier (58), a portion 204 of the sheet to which the tab material 208 is attached is separated away from the rest of the sheet. The tab material 208 is then partially released, folded and reattached similar to the process as described previously to form the printed and outwardly extending tab 212. (Alternatively, after printing, the sheet portion 204 can be separated after the tab 212 has been formed.)

Figure 9:
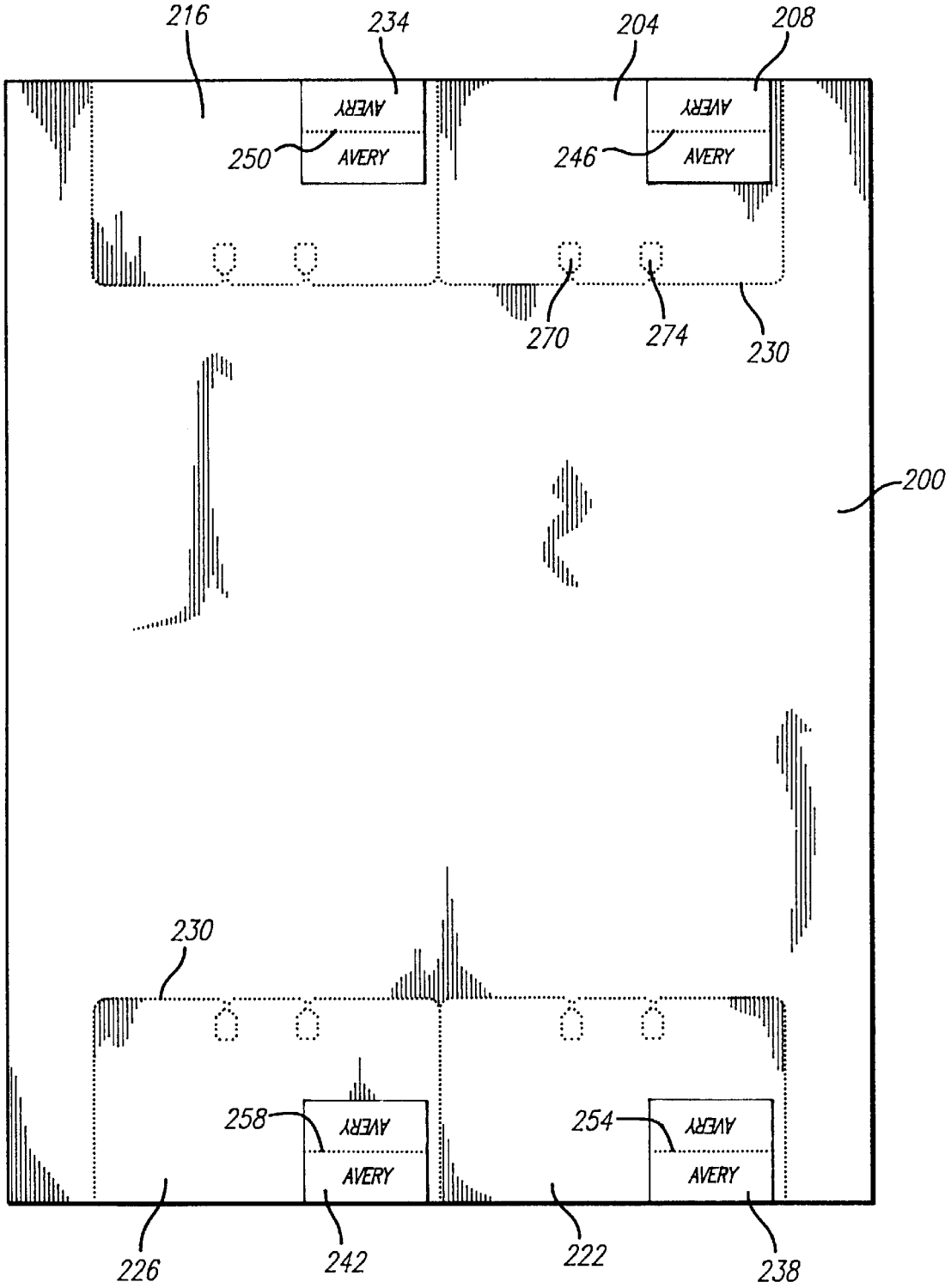
FIG. 9 is a top plan view of an alternative sheet assembly of the present invention for forming tabbed flip-file cards, after a printing operation thereon.
Figure 10:
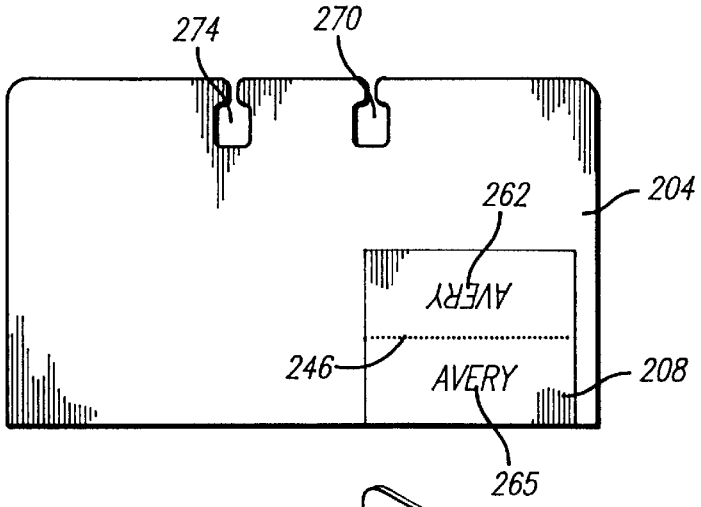
FIG. 10 is a plan view of one of the flip-file cards after separation from the sheet of FIG. 9.
Figure 11:
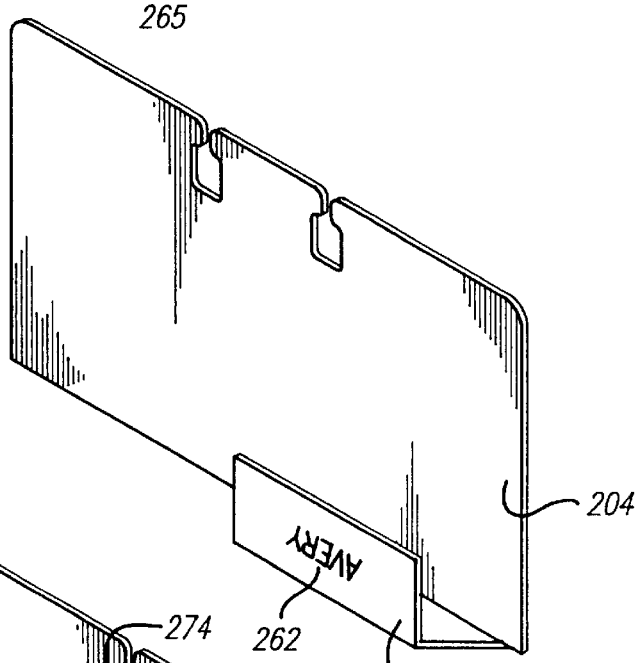
FIGS. 11 and 12 show sequential tab forming steps for the card of FIG. 10.
Figure 12:
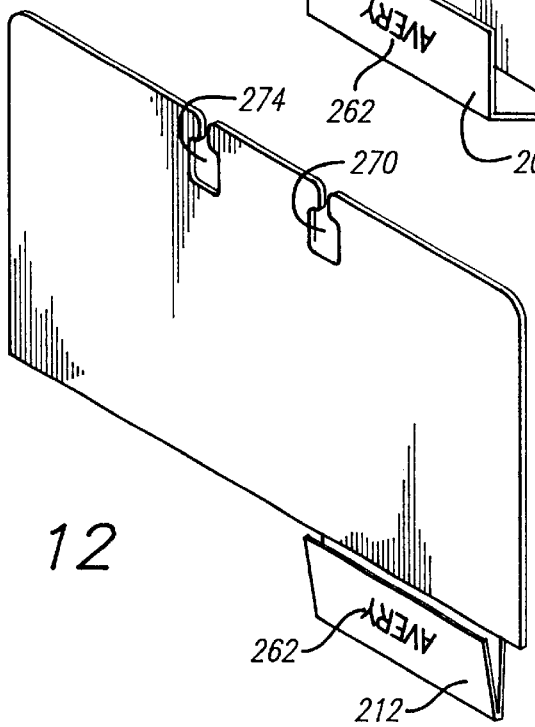

More than one of these smaller end products 204 can be formed from a single sheet 208, and a preferred smaller end product is a flip-file or ROLODEX type card. Referring to FIG. 9, four of these flip-file (small end product) cards 204, 216, 222, 226 are shown defined on a single sheet 208.

Two of the cards (204 and 216 or 222 and 226) abut opposite (portrait) ends of the sheet 208, and the cards at each end abut one another. Perforated lines 230 in the sheet 208 define the portions of the card perimeter not coincident or defined by the sheet edges. A separate tab material 208, 234, 238, 242 is provided for each card 204, 216, 222, 226, the tab material being wrapped around the corresponding edge of the sheet 200 and adhered flat to both sheet faces. The portion of the tab material on one face of the sheet is divided by a (score) line 246, 250, 254, 258. Indicia 262, 266 is printed on both sides of the line by passing the sheet 200 through a printer or copier. That tab material portion is then released, folded and reattached, as previously described, to form an outwardly extending tab 212, with printed indicia 262, 266 on both sides thereof.

The printable media (200) can be a sheet of paper such as ten mil thick cardstock available from Simpson Paper Mill in Pomona, Calif. The paper sheet 200 can have a thickness of preferably between six or seven and twenty mils, and a weight of between sixty and one hundred fifty pounds. Alternatively, the sheet can be a fifty-seven pound vellum bristol, approximately 7.5 mil thick, such as that available from Wausau or Champion, or ninety pound index paper, approximately seven mil thick, such as that available from International Paper.

The microperforations or perforation lines 230 consist of cuts which vary in size from 0.0125 to 0.0135 inch and which are separated by ties that vary in size from 0.0045 to 0.0050 inch. Thus, there are between fifty-three and fifty-nine perforations per inch, with about fifty-six perforations being an average therebetween. However, it is also within the scope of the invention for the perforations of line 230 to be only thirty-five perforations per inch, or in the range of from thirty-five to fifty-nine perforations per inch.

After the printing operation but preferably before this tab forming procedure, the card(s) is (are) separated from the rest of the sheet 200. By pulling along the perforation lines 230 (and thereby) breaking the ties, the card separates out easily, quickly and accurately. Each of the four cards 204, 216, 222, 226 is separated out and its tabs formed. The remainder of the sheet 200 can be discarded, if desired. As seen in the drawings, bulbous shaped slots 270, 274 are formed (by the perforation line 230 in the edge of the card opposite to that of the tabs). These slots 270, 274 are for fitting, in a known manner, the cards onto a ROLODEX type of ringed file (not shown).

Other numbers, shapes and arrangements of flip-file cards defined on the sheet can be provided as would be apparent to those skilled in the art. Each card should preferably abut a sheet edge so that the tab material can be wrapped around the sheet edge and adhered to both faces of the sheet. Instead of flip-file cards, other smaller end products can be formed from a single larger sheet, as would be apparent to those skilled in the art.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A method of forming a tabbed assembly, comprising:

providing a media having first and second faces and an edge;

providing tab material attached to the media on the first and second faces, the tab material having a first end attached to a first attachment location on the first face and a second end attached to a second attachment location on the second face;

releasing the second end of the tab material from the media, wherein the tab material is attached to the first and second faces before the second end is released; and folding the released second end generally onto itself by adhesively adhering one potion of the second end to another portion of the second end, so that the folded released portion or the second end forms a tab extending out from the edge, aid wherein the first end of the tab material remains attached to the first attachment location.

2. The method of claim 1, further comprising reattaching an additional portion of the second end to the second face of the media.

3. The method of claim 1, wherein the first end and the second end are attached to opposing first and second faces of the media.

4. The method of claim 1, wherein the second end include an edge that is substantially aligned with the edge of the media after being folded to form a tab.

5. The method of claim 1, wherein the released second end includes a neck and a bulbous end.

6. The method of claim 1, wherein the tab material is attached to both the first and second faces and wrapped around the edge prior to the second end being released.

7. The method of claim 1, wherein the tab material is attached to the at least one of the first and second faces with adhesive.

8. The method of claim 1, wherein the tab material is a thinner, different material than the media.

9. The method of claim 1, wherein the media is a divider sheet having ring binder holes.

10. The method of claim 1, further comprising printing indicia on the tab material on both sides of a fold line of the tab material, wherein the folding includes folding the tab material along the fold line.

11. The method of claim 1, wherein the media includes a first end and a second end, and wherein the edge is straight from the first end of the media to the second end of the media.

12. The method of claim 1, wherein the media is a flip-file card.

13. The method of claim 1, wherein the media is a sheet of paper.

14. The method of claim 1, wherein the tab material is adhered to the media with permanent adhesive on the tab material and release coating on the second face.

15. The method of claim 1, wherein the first end of the tab material includes first and second segments on the first face.

16. The method of claim 15, wherein the releasing the tab material includes releasing a selected one of the first and second segments from the second face, and wherein the folding the released end includes folding the released segment generally into itself to form the tab extending out from the edge.

17. The method of claim 1, wherein the tab material has an hourglass shape having a narrow waist fold line, wherein the folding includes folding on the fold line.

18. The method of claim 1, further comprising, before releasing the second end of the tab material, passing the media through a printer or photocopier and printing indicia on two locations on the tab material such that printed indicia is on both sides of the tab.

19. The method of claim 1, wherein the tab formed is unattached to the edge.

20. The method of claim 1, wherein the tab material attached to the media extends a full length of the edge.

21. The method of claim 1, wherein the tab material is attached to the media on an indented surface on the second face, and wherein the releasing includes releasing the second end of the tab material is released from the indented surface.

22. The method of claim 1, further comprising forming the tab material as a piece separate from the media and attaching the tab material to the media.

23. The method of claim 1, wherein the tab material is cut into adjacent strips extending inward from the edge.

24. The method of claim 23, further comprising releasing an end of a selected one of the strips from the print media and folding the released strip generally onto itself to form a tab attached to and extending out from the edge.

25. A method of forming a tabbed assembly, comprising:

providing a media having first and second faces and an edge;

providing tab material attached to the media on both of said first and second faces;

releasing an end of the tab material from the second face of the media, wherein the tab material is attached to the first and second faces of the media before the end is released; and folding the released end onto itself and reattaching a portion of the released end to the second face of the media to form a tab attached to the media on both of the first and second faces and extending out from the edge of the media.

26. The method of claim 25, wherein the released end includes a neck and a bulbous end.

27. The method of claim 25, wherein the tab material is wrapped around the edge of the media.

28. The method of claim 25, wherein the tab material remains attached to the first face while the end is released from the second face and folded onto itself.

29. The method of claim 25, wherein the tab material is attached to the first and second faces with adhesive.

30. The method of claim 25, wherein the tab material is a thinner, different material than the media.

31. The method of claim 25, wherein the media is a divider sheet having ring binder holes.

32. The method of claim 25, further comprising printing indica on the tab material on both sides of a fold line of the tab material, wherein the folding includes folding the tab material along the fold line.

33. The method of claim 25, wherein the media includes a first end and a second end, and wherein the edge is straight from the first end of the media to the second end of the media.

34. The method of claim 25, wherein the media is a flip-file card.

35. The method of claim 25, wherein the media is a sheet of paper.

36. The method of claim 25, wherein the tab material is adhered to the media with permanent adhesive on the tab material and release coating on the second face.

37. The method of claim 25, wherein the tab material includes first and second segments on the second face.

38. The method of claim 37, wherein the releasing the tab material includes releasing a selected one of the first and second segments from the second face, and wherein the folding the released end includes folding the released segment generally into itself to form the tab extending out from the edge.

39. The method of claim 25, wherein the tab material has an hourglass shape having a narrow waist fold line, wherein the folding includes folding on the fold line.

40. The method of claim 25, further comprising, before releasing the at least a portion of the tab material, passing the media through a printer or photocopier and printing indicia on two locations on the at least a portion of the tab material such that printed indicia is on both sides of the tab.

41. The method of claim 25, wherein the tab formed is unattached to the edge.

42. The method of claim 25, wherein the tab material attached to the media extends a full length of the edge.

43. The method of claim 25, wherein the tab material is attached to the media on an indented surface on the second face, and wherein the releasing includes releasing the end of the tab material from the indented surface.

44. The method of claim 25, further comprising forming the tab material as a piece separate from the media and attaching the tab material to the media.

45. The method of claim 25, wherein the tab material is cut into adjacent strips extending inward from the edge.

46. The method of claim 45, further comprising releasing an end of a selected one of the strips from the print media and folding the released strip generally into itself to form a tab attached to and extending out from the edge.

* * * * *